United States Patent [19]

Brodersen

[11] Patent Number: 4,919,191

[45] Date of Patent: Apr. 24, 1990

[54] MOLTEN-METAL FORMING METHOD AND APPARATUS WHICH ARE BOTTOM-LOADING, BOTTOM-POURING AND BOTTOM-UNLOADING

[75] Inventor: Craig Brodersen, Reno, Nev.

[73] Assignee: Jeneric/Pentron Incorporated, Wallingsford, Conn.

[21] Appl. No.: 195,765

[22] Filed: May 17, 1988

[51] Int. Cl.[5] ..... B22D 25/00

[52] U.S. Cl. ..... 164/495; 164/61; 164/66.1; 164/133; 164/256; 164/259; 164/514; 75/612; 373/60; 373/72; 219/121.38; 219/121.59

[58] Field of Search ..... 164/5, 133, 250.1, 512, 164/513–514, 256, 258, 259, 262, 337, 48, 492, 493, 494, 61, 62, 63, 66.1, 69.1, 76.1, 495; 75/65 R, 65 EB; 219/121.37, 121.38, 121.59, 121.17; 373/79, 83, 60, 72, 90

[56] References Cited

U.S. PATENT DOCUMENTS

| | | | |
|---|---|---|---|
| 2,806,271 | 9/1957 | Operhall | 164/493 |
| 3,435,878 | 4/1969 | Howard et al. | 164/493 |
| 4,254,817 | 3/1981 | Kidowaki et al. | 164/259 |
| 4,654,858 | 3/1987 | Rowe | 373/72 |

*Primary Examiner*—Richard K. Seidel

*Attorney, Agent, or Firm*—Ashen Golant Martin & Seldon

[57] ABSTRACT

The bottom of a solid metal charge melts to fill a form below the charge. During melting, usually, the metal that enters the form remains continuous with an unused solid part of the charge. After cooling, the formed metal is removed together with the unused part of the charge—and usually with the form too. They are separated later or in a different operation, and another charge is positioned immediately for melting into another form, so the useful duty cycle is very high. A preferred form of the invention uses an upper melting chamber and a lower forming chamber, separated by a horizontal wall but communicating by an aperture through the wall. The charge and form are placed against the wall from below to block the aperture. The charge preferably extends up through the aperture into or toward the melting chamber, where an arc electrode or other heater melts the top of the charge, particularly near its center. A molten core soon extends fully through the charge to the bottom, acting as a self-valve to release metal to the form. The charge and form ideally seal the aperture hermetically; gas pressure is applied to enhance rapid and thorough filling of the form by the molten metal. Removal is by downward motion from the aperture.

38 Claims, 11 Drawing Sheets

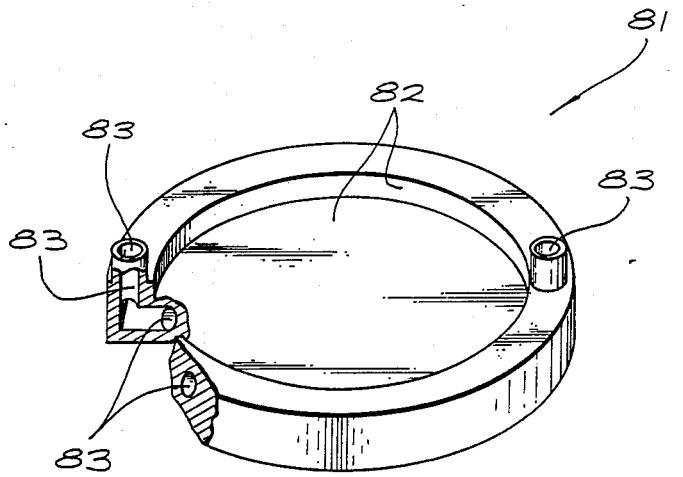
FIG. 10
FIG. 12
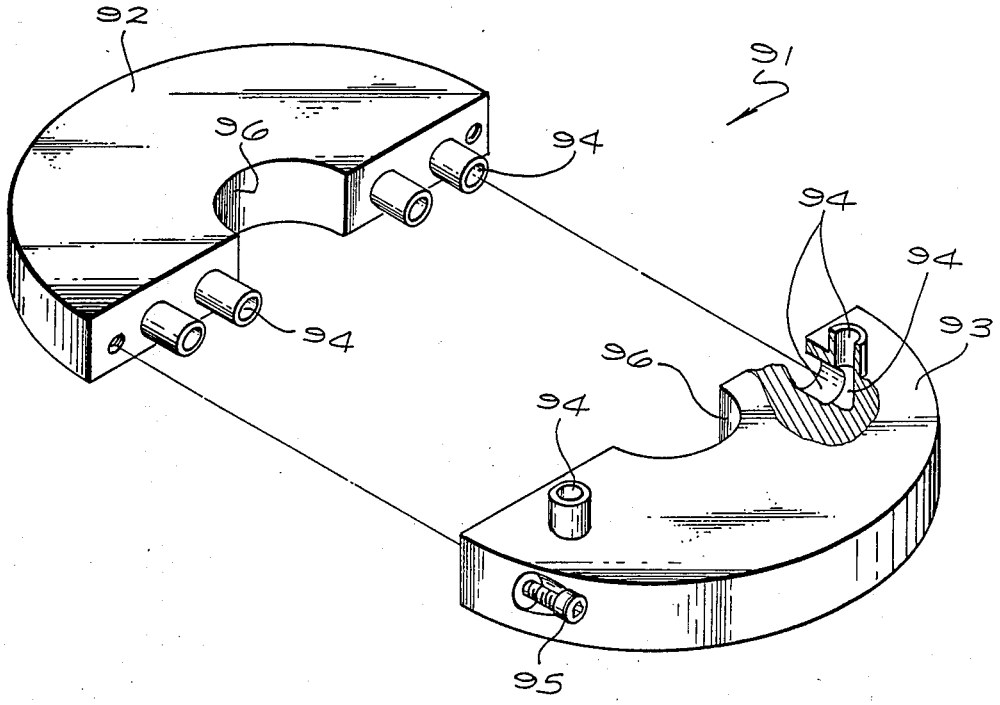

MOLTEN-METAL FORMING METHOD AND APPARATUS WHICH ARE BOTTOM-LOADING, BOTTOM-POURING AND BOTTOM-UNLOADING

BACKGROUND

1. Field of the Invention

This invention relates generally to forming of molten metal; and more particularly to very efficient apparatus and method for forming either small investment castings or ingots. The invention is especially advantageous in casting of extremely reactive and refractory metals such as titanium, but is not limited to such use.

2. Prior Art

Titanium and like metals present a great challenge to efficient manipulation and forming, since they can be heated only with special precautions to prevent both contamination of the metal and damage to the environment. This is particularly true in making so-called "investment" castings, and even in forming ingots, because these metals can be safely melted only in inert or highly rarified atmospheres.

Prior patents in the field of forming molten metal, and particularly forming molten titanium and the like, may be very roughly divided into tilt-to-pour, bottom-pour, and countergravity systems. Each has its own drawbacks.

Tilt-to-pour systems are generally very cumbersome and costly, since moving machinery for the tilting of crucibles and other handling of molten metal must be provided inside an evacuable sealed chamber. Furthermore, the complete filling of a mold can be very difficult, especially when the mold has small intricate details to be formed in the metal.

Such difficulty arises because gas bubbles trapped in the finely detailed parts of the mold deter entry of the molten metal, and the metal when incompletely molten is viscous and sometimes inhomogeneous. If the chamber is operated at very low pressures to avoid gas bubbles, yet other complexities arise.

Typical of such highly elaborate systems is that described in U.S. Pat. No. 3,658,119 to Hunt. In that apparatus electron beams heat and melt a charge in a crucible, and the crucible is tilted to pour the molten charge. Other electron beams keep the metal molten while it proceeds along chutes or conveyors.

Hunt's system is used for forming either useful articles—by which I mean end-product articles, such as dental castings, for use outside the casting industry itself—or ingots for remelting in other steps to make useful articles. Hunt takes a direct approach to loading his furance: a conveyor drops particulate metal into the crucible.

U.S. Pat. No. 4,154,286 of Glazunov illustrates one technique for achieving a complete fill of the mold. His crucible tilts to pour into a "pressmould," a device with a piston that drives molten metal into the mold.

Another U.S. Pat. No. 3,807,488 to the same inventor shows how to make thin-walled workpieces centrifugally, by spinning a large round mold that receives molten metal from a tilted crucible. In the device of each Glazunov patent, a consumable electrode drips molten metal into the crucible.

Yet another tilt-to-pour system is described in U.S. Pat. No. 3,273,212 of Garmy. That system too uses a consumable electrode, but further allows additional particulate charge to be fed from above as in Hunt. As to mode of loading it is thus a hybrid system. Garmy also teaches use of the "skull"—the unmelted solid portion of the metal charge in the crucible—as a noncontaminating liner for the crucible.

One step more sophisticated than the tilt-to-pour technique is the bottom-extraction or bottom-pour strategy, which is mechanically advantageous in that the crucible need not be bodily tilted. The general principle here is to provide an opening at the bottom of the crucible and simply move metal downward out of that opening.

In making ingots, it is not generally necessary to shape the top of an ingot narrower than the lower portions. This fact provides a degree of freedom not generally available in making castings.

Hence U.S. Pat. No. 3,894,573 of Paton makes shaped ingot by dripping metal from a consumable electrode onto a piston-supported floor in a vertical cylindrical form. While continuing to operate the melting arc, Paton continuously "extracts" formed ingot at the bottom by retracting the piston.

As in two of the patents already mentioned, Paton suggests that scrap metal may be remelted into the pool of molten metal by loading from above. When the elevator is fully lowered, he opens the bottom of the form, removes the tall cylindrical ingot, and reseals the apparatus for the next cycle.

U.S. Pat. No. 4,197,900 of Bloshenko discloses a similar ingot form with a detachable bottom plate. One may infer, although the disclosure does not so state, that ingot is removed at the bottom of the form.

Similar ingot-forming systems are known in which only top-loaded particulate makes up the charge, which is melted by a nonconsumable electrode. Thus early U.S. Pat. No. 2,727,937 of Boyer discloses a movable mold floor on an elevator. The floor is lowered during operation, as in Paton, to maintain the arc length.

The charge is added by dropping particles from a hopper. After operation the elevator is lowered further for bottom removal of finished ingot. Boyer's nonconsumable electrode is a water-cooled copper coil.

Such prior-art systems are generally reliable and efficient for forming good-quality ingot. The prior art has failed, however, to produce adequate systems for making castings; and has accordingly failed to produce adequate systems that can be used for both castings and ingot.

Unfortunately, as suggested above, the problem of finished-part removal is more complicated and difficult for castings than for ingot. This fact is illustrated by consideration of the bottom-pour casting systems disclosed by Waterstrat in U.S. Pat. Nos. 4,538,671 and 4,627,482.

In these patents it is indicated that premature release of molten metal into a mold must be prevented by some sort of valving function. Waterstrat shows both a fusible foil and a mechanical valve as alternatives for use in the valving function.

As to the mechanical valve, a relatively coarse valve action is desirable since molten titanium and the like may be expected to clog and possibly obstruct the operation of most sorts of precision-acting valve. Clogging is likely to be especially troublesome if water cooling of the valve is provided. If the valve is not cooled, however, then contamination of the melt and short equipment life may be expected instead.

Waterstrat apparently prefers the fusible foil, since it permits the mouth of the mold to be sealed around the melt-flow channel from the crucible. This in turn facilitates evacuating the volume around the mold, to obtain a pressure-differential assist to complete filling of the mold.

In both cases—whether foil or valve—there results a constriction in the system, between the pool of molten metal and the interior of the mold. In many situations the mold itself defines such a constriction anyway, but in the Waterstrat system even the best efforts of the mold designer cannot avoid a constriction.

Thus there is an inherent difficulty with the Waterstrat configuration: if the molten metal is allowed to cool both above and below the constriction, while the pouring channel is open, the molded part will thereby be frozen to the casting apparatus.

On the other hand, if this trap is to be avoided, either the valve must close when the mold is just exactly full, or the charge must be exactly the right size so that—when melted—it just fills the mold (subject to tolerances provided by the length of the flash channel).

The first of these solutions militates against using a fusible foil, since such a foil once fused cannot be closed again. The foil is relatively undesirable anyway, since it actually melts into the molten charge and so constitutes a source of contamination to the part being cast; furthermore a new foil must be installed with each new charge, introducing additional cost and delay.

If the mechanical valve is used, however, then sealing around the mouth of the mold becomes very awkward. The previously mentioned coarse action of the valve—which is evident in Waterstrat's illustrations—appears generally incompatible with establishment of a clean, clog-free and contaminant-free flow channel for the melt.

The second solution suggested above (making the charge exactly the right size) has its own problems. For one, the top of the system must be opened and a complete new charge provided for each new mold. For another, small changes in operating conditions may throw off the relationship between charge size and mold volume—as, for example, by changing the volume of the flash channel. For still another problem, some production lines make different-size parts at each cycle, and each solid charge must therefore be matched to its mold.

The operation of opening the top of the system to install a new charge is particularly objectionable. That operation must be performed in addition to opening the bottom of the system to position the mold.

Every added operation that must be performed to prepare the furnace for making the next casting is a serious matter. The economics of operating refractory-metal casting furnaces demand high throughput of parts.

Additional process steps elsewhere in the production line may be readily tolerable. The furnace, however, is usually the point of greatest capital investment and therefore in terms of economics is the process bottleneck.

Nevertheless at least one other patent echoes Waterstrat's precautions against premature release of the molten metal. U.S. Pat. No. 4,471,831 to Ray describes a bottom-pour system for making metal ribbon. Ray says it is one of his objectives to make "the charge fully melted before the molten material is ejected."

These concerns over premature release are readily understood, and in fact are important. In a system of the Waterstrat type, if the charge is not fully melted, globules of viscous metal are likely to plug the mold—either in its necked-down entryway (the flash channel), or in finely detailed internal features that are provided to form details of the casting.

Ray's system is free of these particular problems, since he pours molten metal through the bottom of his crucible onto the periphery of a rotating vertical wheel. Still he discloses three different liquid-metal release systems for obtaining these objectives: (1) a valve with a shutter, (2) a low-melt plug, and (3) a valve with a stopper rod.

All three of these release systems pose significant contaminante problems. Furthermore the low-melt plug, like Waterstrat's fusible foil, is not reusable; and the two valves are subject to clogging or obstruction of the mechanisms, or both.

As already suggested, the ultimate potential problem with all such valving systems is in the possibility of the flash solidifying while it is still continuous with the melt in the crucible. Such solidification can result in lockup of the entire system—possibly requiring disassembly of the valve to obtain release.

It is therefore natural that Ray, in particular, provides an auxiliary heater in the nozzle. The prior art, in summary, teaches that (1) a controllable valving function is required to prevent premature release of metal that might be incompletely melted; and (2) the flash must be prevented from solidifying in the valve.

The foregoing discussion makes clear that the metal-release technique is critical to success of a casting system, or a system capable of making both casting and ingot. The prior art lacks a release system that is contaminant free, is reliable and smooth in operation, is recyclable quickly and economically, is amenable to provision of a pressure differential to aid in rapid, complete filling of the mold, and of course prevents premature release of only partially melted metal.

One type of known metal-casting system does satisfy nearly all these requirements; unfortunately, however, it appears practical only for very specialized applications. In that type of system, gravity acts as the "valve" closure, and suction acting against gravity acts as the release.

Typical of such "countergravity casting" systems is U.S. Pat. No. 4,658,880 of Voss. Voss's mold is made porous, and is inverted from a conventional orientation—so that the flash channel of the mold is at the bottom.

In operation, the open end of the flash channel is first immersed into a molten pool of the metal to be cast. Then a partial vacuum is applied to the exterior of the porous mold, to draw liquid metal up into the mold and against its porous wall.

Countergravity systems have the interesting property that unused material can be allowed to simply run back out of the mold and into the supply pool. They also have the properties that the charge in the supply pool is loaded from above, and "pours" upward from the pool into the mold; and that, after cooling, the mold and casting are removed upward from the pool.

In other words, the system is top-loading, top-pouring and top-unloading. This unusual combination of characteristics facilitates a relatively unencumbered and therefore efficient movement of material, molds and finished parts.

Such systems are particularly well adapted for making thin-walled, rough-interior castings. These systems do not appear feasible for general application such as investment casting of dental work or other intricate articles.

To completely fill all the detailed features in a mold by vacuum countergravity pouring is probably difficult. As will be appreciated, once the pores of the mold surface are full and the metal has begun to cool, the upward draw of the suction is greatly reduced. With this exception, however, countergravity systems do have essentially all the desirable characteristics enumerated above.

Another type of metal-melting system that is in actual use, though I know of no patent covering it, is an induction-heated pour-cup system. As far as I know, it is used only for nickel-based alloys, never for reactive or refractory metals, and the cup is simply a ceramic material rather than graphite or water-cooled metal as in titanium work and the like.

That system is remote from those already discussed, and is of interest only because it is in a sense bottom loading: the cup is advanced into the induction coil from below. The cup can be either tilted (together with the induction coil) to pour, or provided with a bottom-pour aperture.

SUMMARY OF THE DISCLOSURE

My invention encompasses both apparatus and method for forming of molten metal.

One embodiment of the apparatus of my invention is a furnace for use with a solid charge of metal, and for use with a form for receiving molten metal. The furnace includes a structure defining a melting chamber (or "melt chamber") that has an aperture.

The furnace also includes a structure defining a forming chamber. The forming chamber is at least partially below the melt chamber, and communicates with the melt chamber through the aperture.

In addition this embodiment of the apparatus must have some means for receiving such a solid charge of metal from below to block the aperture. For purposes of generality in expressing my invention, I shall refer to these as the "receiving means."

This embodiment also must have some means for heating such a charge to melt part of the metal. Again for generality, I shall call these the "heating means." The heating means are associated with the melt chamber.

The furnace of this embodiment of the apparatus also requires some means for positioning or disposing the form to receive molten metal from the bottom of the charge. These means, again, I shall call the "disposing means." The disposing means serve to hold the form in the forming chamber, below the charge.

Now the foregoing may be a definition of one embodiment of my invention in its broadest or most general terms. Even without any further particulars it should be appreciated that this broad embodiment of my invention solves all of the previously described problems of the prior art.

When the heating means operate to melt part of the metal charge, and a sufficient amount of melting occurs for the form to recive molten metal from the bottom of the charge, the form can receive molten metal until it is full. When operation of the heating means then ceases, the remaining part of the charge resolidifies—along with the metal inside the form and, usually, the flash or flow between the charge and the formed metal.

As long as the heating means stop operating before the entire periphery of the solid charge melts, the periphery of the charge remains a solid structure, positioned to block the aperture between the chambers. The resolidified charge can then be removed by downward motion from the aperture, together with the formed metal inside the form and the resolidified flow between the charge and mold.

The charge, the formed metal ingot or part, and the resolidified flow can then be taken away from the furnace, and the metal-forming operation can immediately be resumed with the next mold and another charge. While the furnace operation continues, the charge can be separated from the formed metal and from the resolidified flow by other personnel, or at another work station, or both.

The separation is accomplished by sawing away the flow from the bottom of the charge, and if desired remachining the bottom of the charge flat. In addition the separation includes machining or sawing the flash from the top of the formed part or ingot—to shape the top of the formed metal as required for its intended use.

If desired, particularly in a fabrication facility having only one or two furnaces, this work can be done by the furnace operator. These brief steps are easily accomplished during the dead time required for unavoidable operations such as pumpdown, flushing with inert gas, cooling and so forth.

As will be seen, the remaining part of the charge can later be replaced in the furnace with another mold, and another quantity of metal melted from the bottom of the same charge into this other mold. Likewise, "scrap" pieces of resolidified flow that are cut away from the bottom of the charge can be simply placed into the concavity in the top of the same charge—or another charge—and remelted to reconstitute a full charge.

A primary advantage of this system is that it has no mechanical valve or other discrete barrier to be opened or closed, and that could be frozen or locked into the melt upon resolidification. Rather, the charge itself can provide the only valving function for release and control of the molten metal.

Another advantage is that this self-valve need not shut off promptly and precisely. Virtually the only requirement is that heating cease before the periphery of the charge melts. If the form is disposed immediately below the charge, there is nowhere for the molten metal to go but into the form—and once the form is full, the molten metal simply remains as a pool.

This system is contrary to established conventional teachings, described earlier. Again, in this system there is no separate valve to avoid premature release of molten metal; furthermore no effort is made to maintain the metal molten along the path between the charge and form.

I find that by moderately careful control of the heating means it is easy to bring the core of the charge to a reasonably uniform state of melting, except for a solid thin layer at the very bottom. It is then possible to abruptly increase or "bump" the heater power so that this bottom layer too melts cleanly and smoothly, initiating smooth, nonviscous flow of the molten metal into the form.

Consequently there is no need for a separate valve to prevent premature metal release. A brief training period for the furnace operator replaces or obviates the need for such equipment.

Further, as already shown, solidified metal along the flow path is more readily removed than prevented. In this situation, I have found that an after-the-fact "cure" is easier and more satisfactory than "prevention."

My invention, as seen from this discussion of just one of its several embodiments, accordingly resolves the inadequacies of the prior art. To enjoy the greatest benefits of this embodiment of my invention, however, I prefer to practice it with certain additional features or characteristics, some of which I shall mention now.

First there is something that should be understood regarding the solid charge and the form. They were both mentioned above as part of the environment, or context, of that embodiment of my invention which is now under discussion. Instead, however, the charge may be, for some purposes, actually part of the invention itself.

Likewise for some purposes the form may instead be an element of the invention. These alternative conceptualizations of my invention will be clear in the appended claims.

The form may be a mold for casting of a "useful article" as defined earlier. Instead it may be merely a shaped sealing plate for reconstituting a complete solid charge for use in casting.

One preferable feature of my invention is that the heating means should include means for melting a certain portion of the solid charge to flow through the bottom of the charge into the form. More specifically, these "melting means" melt a very generally central portion of the charge, while leaving at least part of a peripheral portion of the charge solid.

I also prefer to make the receiving means so that they include relatively cool surfaces. These cool surfaces are for drawing heat away from at least some immediately adjacent portions of the charge—to maintain those portions as a skull in the solid state.

From this last statement I mean it to be understood that the cool surfaces of the receiving means do not necessarily draw enough heat away from all of the immediately adjacent portions of the charge to keep all of those portions solid. Some of the adjacent portions of the charge must remain solid, but some may become liquid. In particular, it is permissible for the top of the charge to melt all the way to its periphery—that is to say, for the molten pool to extend all the way to the cool surfaces of the inside of the aperture between the chambers.

I do prefer, however, that the heating means and the cool surfaces of the receiving means cooperate with each other to maintain a skull around the entire periphery of the charge. The point of this arrangement is to limit contact of the molten portions of the charge to exclusively (1) the skull and (2) the mold.

In this way it is possible to prevent contact of the molten portions with even the water-cooled metal walls of the melting and molding chambers, and of the aperture between the chambers.

I also prefer to provide some means for hermetically sealing the charge against the receiving means, to isolate the melt chamber from the forming chamber. In conjunction with these "sealing means" I prefer to include some means for establishing a pressure differential between the chambers. This differential promotes complete filling of the form by the melted metal.

Several other preferred features will be discussed in the detailed-description section of this document. First, however, I wish to point out certain other embodiments of the apparatus of my invention, and also the method.

In the embodiment introduced above, I mentioned means for receiving a solid charge of metal to block the aperture between the chambers. That wording implies that the metal charge must span the aperture, although it may also extend upward into or even through the aperture—toward or into the melting chamber.

The charge then can be sealed axially against the receiving surface or undersurface of the wall between the chambers. If preferred it can be sealed radially against the interior of the aperture, although this configuration may be considerably touchier to implement reliably.

While I prefer these geometries, they are not absolutely required. In another embodiment the metal charge may instead fit loosely within the aperture, supported upon the form. Sealing of the aperture may then be accomplished by an upper surface of the form, that seals against the underside of the interchamber wall.

If desired, in such configurations, the center of the upper extremity of the form may be slightly concave upward, so that the charge fits within a funnel shape in the top of the form. If desired, this funnel portion of the form may be at the top of a pillar or tube that extends upward within the aperture, into or toward the melting chamber.

In such configurations, there are not necessarily any means for receiving a solid charge of metal to block the aperture between the chambers. Rather there are instead means for receiving such a solid charge of metal and such a form together, from below, to block the aperture. In other words, the blocking of the aperture need not be effected by strictly the charge itself, but rather may be produced by either the charge or the form, or by both in combination.

Still another embodiment of my invention employs heating means that do not necessarily have a discrete melting chamber—and accordingly may lack a separating wall and aperture. For example, it is possible to use an inductive heater coil surrounding the charge, or possibly an electron beam or other energy beam aimed at the center of the charge from below.

Such configurations remain within the scope of my invention if they have means for preferentially heating a very generally central portion of the charge. These means melt exclusively that central portion, so that at an underside of the charge molten metal flows downward from exclusively the central portion into the mold.

The preferential heating means operate in such a way that the molten metal remains continuous with an unused solid peripheral portion of the charge. After cooling, as in previously discussed embodiments of the apparatus, the formed metal remains linked by the resolidified flow to the unused solid part of the charge.

In addition this embodiment of my invention has some means for facilitating removal of the molten metal, after cooling, by downward motion together with the unused solid peripheral portion of the charge.

Now I shall turn to the metal-forming methods provided by my invention.

One particularly preferred embodiment of my invention includes the following steps. They need not occur in the order in which they appear, except to the extent specified.

(1) positioning, from below, a solid charge of the metal against a receiving surface—at an aperture in the receiving surface that communicates with a melting chamber;

(2) disposing a mold below the charge;

(3) after the positioning and disposing steps, operating a heater in the melting chamber—to heat an upper surface of the charge to melt a portion of the charge;

(4) continuing to operate the heater so that the melted portion of the charge extends vertically to the bottom of the charge, and so that molten portions of the charge run from the bottom of the charge into the mold;

(5) after the continuing step, allowing molten portions of the charge to cool; and (6) after the allowing step, removing the remaining charge—by downward motion from the receiving surface—and removing the mold and the molded metal from the mold chamber.

In step (4), the continuing step, unmelted portions of the solid charge provide the exclusive containing function for restraint of the molten metal. Also during that same step, the extending of the melted portion of the charge to the bottom of the charge provides the exclusive valving function for release of the molten metal.

Another embodiment of the method of my invention includes the following steps:

(1) positioning a solid charge of the metal in a furnace;

(2) disposing a mold below the charge;

(3) after the positioning and disposing steps, operating a heater in the furnace to melt a portion of the charge that includes a part of the bottom of the charge, so that at least some of the molten portion of the charge runs from the bottom of the charge into the mold;

(4) after the continuing step, allowing molten portions of the charge to cool; and (5) after the allowing step, removing the remaining charge, the mold and the molded metal in the mold all together from the mold chamber.

Here in step (3), the heater-operating step (as in step (4) of the previously-described method), unmelted portions of the solid charge provide the exclusive containing function for restraint of the molten metal; and the extending of the melted portion of the charge to the bottom of the charge provides the exclusive valving function for release of the molten metal.

In addition, still with reference to step (3) of this second embodiment of my novel method, molten portions of the charge that run into the mold remain continuous with unmelted portions of the charge positioned in the furnace. Upon reflection it will be appreciated that this last-mentioned condition, together with step (5) stated just above, makes my method very different from the operation of some consumable-electrode systems such as that of Paton.

These two descriptions of embodiments of the method of my invention may be definitions of those embodiments in their most general or broad forms. As with the apparatus embodiments, however, for optimum enjoyment of the benefits of the invention I prefer to practice my method with certain additional steps or features.

In the first-mentioned method, for example, I prefer to add two other steps:

before the continuing step, hermetically sealing the charge against a part of the receiving surface that surrounds the aperture, to sealingly block the aperture; and after the sealing step, reducing pressure in the mold chamber so that inert gas in the melt chamber tends, during the continuing step, to propel the molten metal downward into the mold.

In the second-mentioned method, as another example, I prefer to add the step, after the removing step, of separating the remaining charge, the molded metal in the mold, and the mold all from each other.

The benefits or advantages, as well as the principles of operation, of the methods of my invention are generally similar to those stated above for the apparatus embodiments. All of those principles and advantages will be more fully appreciated upon consideation of the following detailed description, with reference to the appended drawings, of which:

BRIEF DESCRIPTION OF THE DRAWINGS

FIG. 10 is a perspective view of a sealing plate for use with the FIG. 1 furnace in reconstituting a charge after a short or marginally adequate pour such as that shown in FIG. 9;

FIG. 12 is a perspective view of a segmented pouring plate for use with the FIG. 1 furnace.

DETAILED DESCRIPTION OF THE PREFERRED EMBODIMENTS

Figure 1:
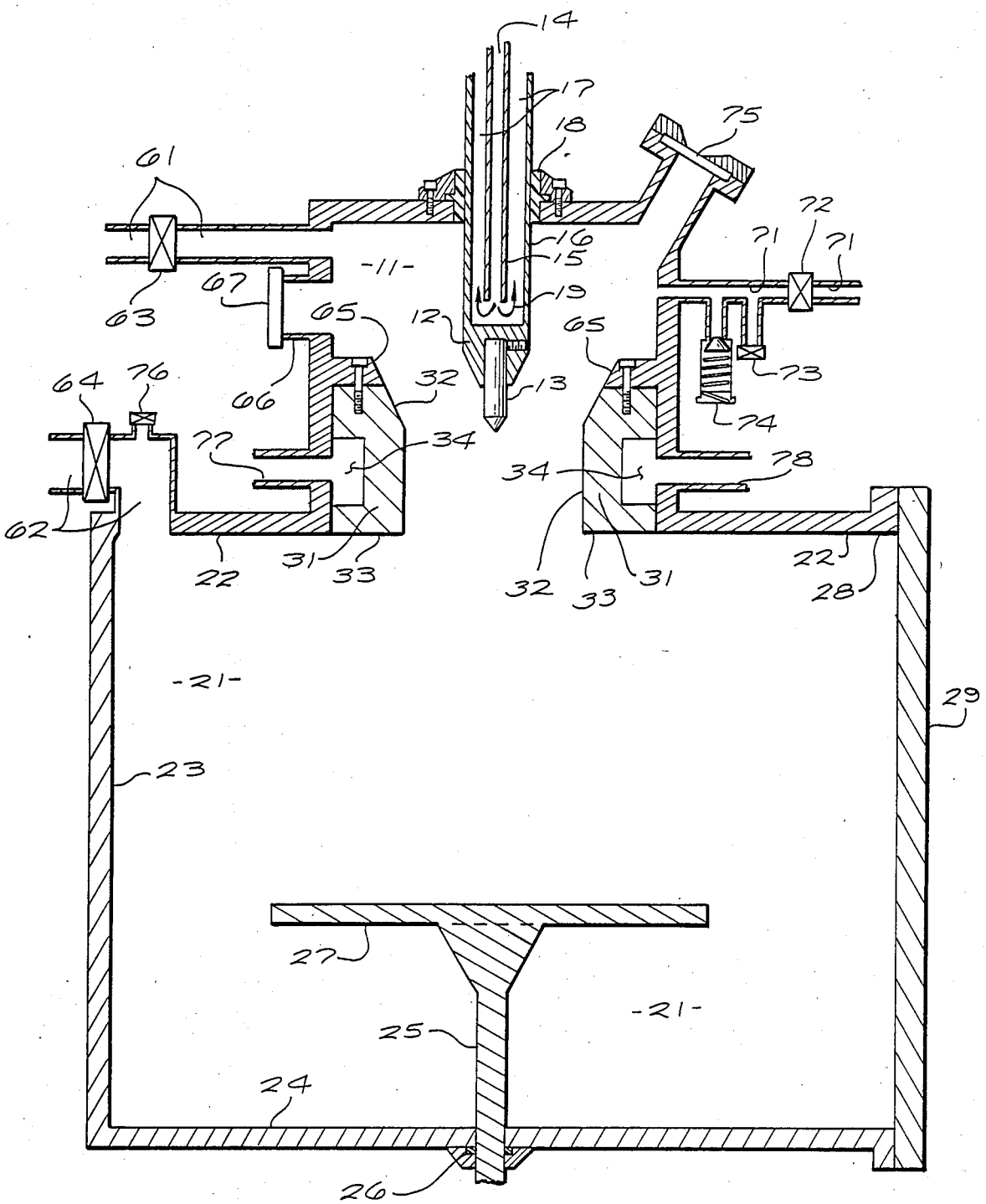
FIG. 1 is a cross-sectional elevation of a metal-forming furnace in accordance with my invention.

As shown in the drawings, a preferred embodiment of the furnace of my invention—and of a furnace that can be used in practicing the method of my invention—includes a melting chamber 11, a forming chamber 21, and a wall structure 31 separating the two chambers. The chambers are in mutual communication by an aperture 32 that passes through the wall 31.

Mounted in the melting chamber 11 is an electrode 12 with a replaceable tip 13 of, e.g., tungsten, water-cooled copper, or graphite. Except for the portion near the tip, the electrode 12 is a coaxial double structure made up of an inner copper tube 15 and a coaxial outer copper tube 16.

A central water inlet 14 is defined by the volume within the inner tube 15. An annular water outlet 17 is defined between the outer wall of the inner tube 15 and the inner wall of the outer tube 16.

At its bottom end, the central tube 15 is open to the interior of the outer tube 16. Consequently water fed into the inlet 14 can reverse direction—as indicated by the flow-path arrows 19—and leave the electrode through the annular outlet 17.

The outer tube 16 is mounted to the ceiling of the melting chamber 11 by a shaped bush 19, preferably of the self-lubricating material available commercially under the trade name Teflon, which is circumferentially grooved to accept an O-ring. This combination of bush and O-ring allows the furnace operator to tilt and wobble the electrode manually, for purposes to be explained below.

Conventional electrical connections and a conventional electrical power supply (not shown) between the electrode 12 and the wall structure 31 place the electrode at a thirty- or forty-volt potential relative to the wall. The power supply must develop adequate power to melt the charge.

If preferred the entire electrode structure 12 and associated electrical equipment can be replaced by a device of the type known as a "plasma torch."

The forming chamber 21 includes ceiling panels 22, walls 23, and a floor 24. A hydraulically or mechanically driven piston 25 is mounted for vertical motion through a hole in the floor 24, and sealed with an O-ring 26. Supported on the top end of the piston 25 is an elevator floor 27.

One entire end of the forming chamber 21 is preferably reserved for use as a flanged access port 28, and a sealable door 29 is suspended at the flange as a closure for this port. Of course the door 29 is provided with suitable hinges and a latch (not shown) for easy operation.

Additional features of the furnace include respective high-vacuum ports 61 to the melting chamber 21 and 62 to the forming chamber 11, each with its respective valve 63, 64. A strong bulkhead 65 is formed as a transverse internal flange 65 for secure mounting of the wall structure 31.

An emergency overpressure-relief port 66 is provided in a side wall of the melt chamber 11, and fitted with a rupture plate 67. This equipment is intended to avoid destruction of the furnace in event of malfunction leading to an explosion.

Also defined in a side wall of the melting chamber 11 is an inert-gas inlet 71, which is provided with a gas-supply control valve 72, a vent valve 73 and an adjustable pressure-relief unit 74. This latter pressure-relief unit 74 is designed merely for control of supply-gas overpressure, rather than violent explosions.

A viewing window 75 is mounted to a port in an upper corner of the melting chamber to permit observation of the electrode operation. If desired an optional revert feed port (not illustrated) can be provided in the ceiling or wall of the melting chamber.

Under extraordinary circumstances such a port can facilitate returning process scrap—or feeding other particulate metal—to reconstitute a charge, as will be explained below. For reasons that will very soon become clear, however, in normal operation of my furnace a revert feed port is superfluous.

Another feature of the furnace is a vent valve 76 fitted to the forming chamber 21. This valve can be used to release the vacuum in the forming chamber so that the door 29 can be opened.

An optional feature of the forming chamber 21 is a charge clamp (not shown), that can be secured to the chamber ceiling 22 adjacent to the receiving undersurface 33 of the chamber-separating wall 31. Since the charge is normally supported on its mold, no clamp is usually needed.

Water inlet and outlet ducts 77, 78 are respectively provided in opposing side walls of the furnace, at the level where the wall structure 31 is mounted. The wall structure 31 in turn has a circumferential channel 34 that communicates with the inlet and outlet ducts 77,78. This circumferential channel 34 serves as a water-circulation duct—for cooling of the aperture surface 32 as well as the charge-receiving undersurface 33.

Figure 2:
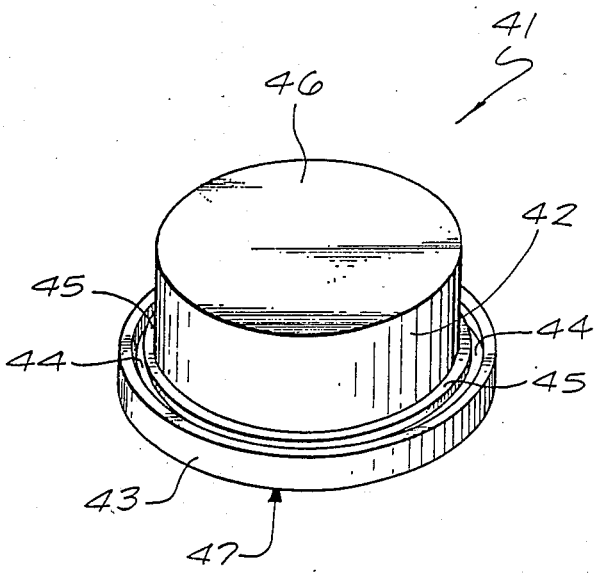
FIG. 2 is a perspective view of a solid metal charge for use in the FIG. 1 furnace.
Figure 3:
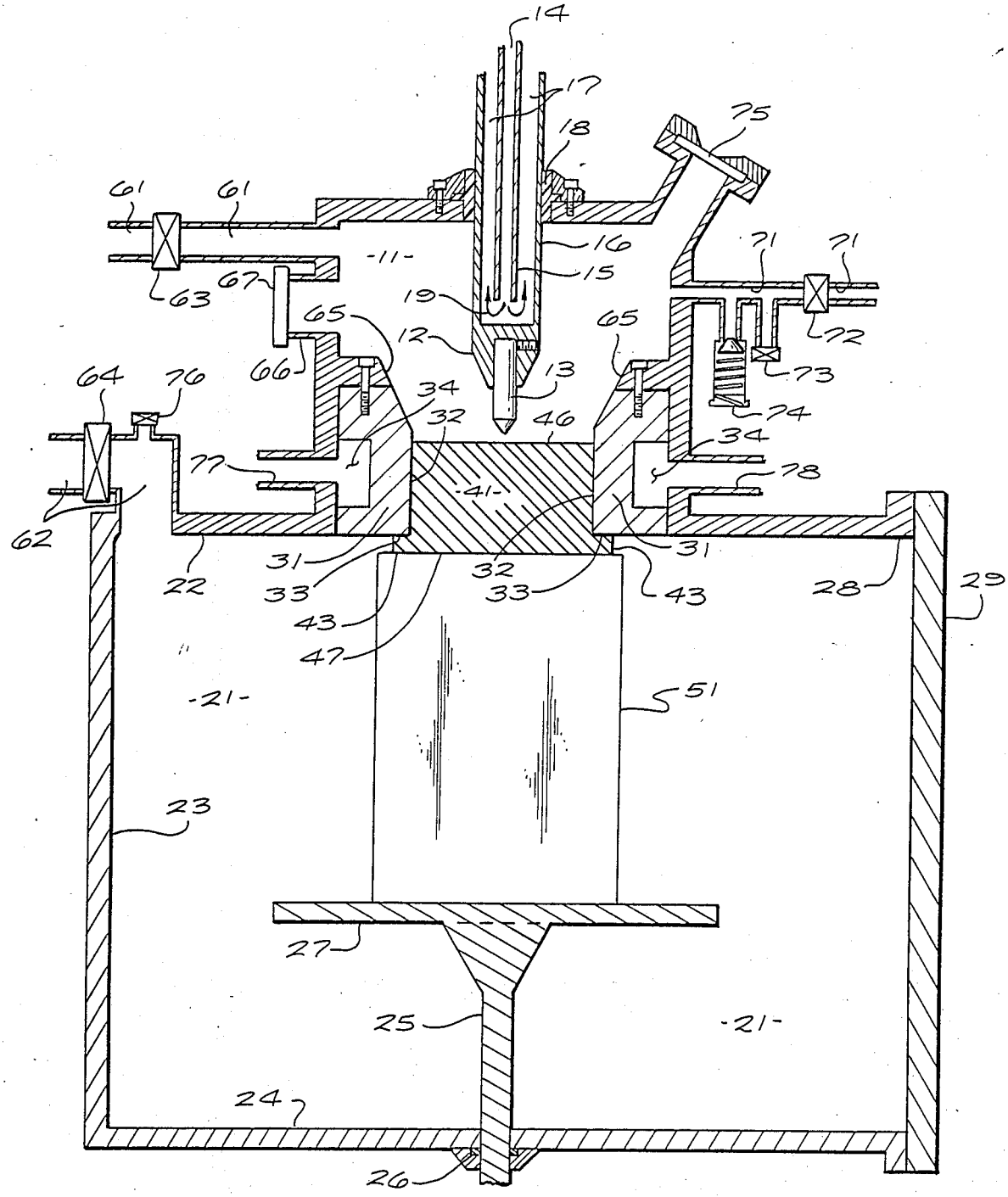
FIG. 3 is a cross-sectional elevation like FIG. 1, but with the metal charge and a representative mold disposed in the furnace, ready for casting, before heating begins.

As shown in FIGS. 2 and 3, a charge 41 of titanium or other metal for use in my invention is generally cylindrical, having a broad central pedestal 42 and at its bottom end an external flange 43. Both the upper and lower surfaces 46, 47 of the charge 41 are generally flat, but only at the bottom surface 47 is any particular accuracy of flatness required—since the bottom surface 47 preferably engages the upper end of the mold, around the mouth of the mold.

If desired, an O-ring groove 44 (FIG. 2) can be cut in the upper surface 47 of the charge. Depending upon the tightness of fit desired for the outer cylindrical surface 42 of the pedestal, relative to the inner cylindrical surface 32 of the furnace aperture 32, it may be desirable to space the groove 44 away from the pedestal 42 by a shoulder or ledge 45—so that the O-ring will positively engage the receiving undersurface 33 that is around the aperture 32.

Another possibility is to groove the cylindrical surface of the central pedestal 42, preferably near its bottom end where less heat is generated in operation. In that case the seal is between the cylindrical surfaces of the charge 41 and wall aperture 32.

In some situations the seal is preferably located there; however, I prefer generally to use the planar surfaces for sealing. In most situations they are cooler, undergo less dimensional change in operation, and are less exposed to molten-metal splash.

Alternatively, an O-ring groove (not shown) can be cut into the receiving undersurface 33, or into the cylindrical aperture surface 32, of the wall structure 31, so that the charge 41 need not be grooved at all. Yet another alternative is to groove both the wall and the charge, at different diameters on the planar surfaces or different heights along the cylindrical surfaces (or one of each), to provide a serial or redundant seal.

It will be understood that most users of my invention will have, for each furnace, at least several charges 41 and perhaps only one annular wall element 31. Accordingly it may be supposed preferable to cut an O-ring groove only in the wall structure 31, since thereby only one groove will have to be cut.

Parts of an investment furnace for titanium or the like, however, are subjected to high temperatures, large distorting stresses and various other adverse conditions. In actual practice therefore, depending upon the particular combinations of conditions actually encountered in any given facility, the best location for the seal may be found only through a certain amount of trial and error.

Thus it may be determined that a better seal is maintained for a greater number of operating cycles by placing the O-ring groove in one or another part, or in one or another location on that part. Once a charge blank 41 is prepared for use, moreover, it can be reused indefinitely unless damaged by an unusual incident; hence grooving the charge is not burdensome, although it might seem so at first thought.

Still another possibility within the scope of my invention is to cut no O-ring groove at all, but to use instead a flat gasket or even a metal-to-metal seal. Any of these alternatives is a reasonable candidate for use in a particular situation, depending upon the size of the mold and charge, and various other operating conditions.

I have found that with experience some predictability of these practical operating choices develops. In my own work I generally prefer to use replaceable O-rings, made of the material available commercially under the trade name "Viton," or the like, and to cut a guide groove for the O-ring into the upper planar flange surface of each charge as shown in FIG. 2.

The charge 41 is usually best supported against the wall 31 and receiving undersurface 33 by upward pressure from the mold 51, as shown in FIG. 3. The mold 51 in turn is supported and pressed firmly against the charge 41 by upward action of the elevator 25–27.

The mold 51 itself is ceramic, sand or a metal die casting. It is preferably porous, or at least finely perforated at suitable points—particularly if the mold 51 has small intricate details 54 that are to be reproduced in the finished, cast part.

By means of such porosity or perforations of the mold 51, its interior fine details 54—which will shape the molten metal into small outwardly extending details of the cast part (such as sharp corners)—are in effective communication with ambient. That is to say, here, the internal details 54 of the mold 51 are in communication with the atmosphere in the forming chamber 21. The mouth 52 of the mold 51 should be generally centered under the charge 41, for reasons that will become apparent.

When the charge and mold are positioned as shown in FIG. 3, and the door 29 and other orifices well sealed, the operator opens the high-vacuum valves 63 and 64 to evacuate the furnace. Since the charge 41 (or mold 51) is sealed against the aperture surface 32 or 33, both chambers 11 and 21 must be separately connected to the vacuum system.

When air has been effectively removed from the melting chamber 11, the high-vacuum valve 63 to that chamber is closed and the inert-gas supply valve 72 opened. Argon, helium or another suitable gas is thereby admitted to the melting chamber to support an electrical arc that will heat the charge.

Alternatively, in some special situations the sort of support shown in FIG. 3 may be undesirable. When that is so, the charge 41 may be secured against the receiving undersurface 33 by a peripheral clamp (not shown) as mentioned earlier.

In that case, with the charge 41 clamped against the undersurface 33 of the wall 31, the upper chamber 11 can be pumped down and filled with inert gas while the lower chamber 21 is still open and the mold 51 is being moved into position. This latter step must be done carefully to avoid disturbing the seal between the charge 41 and aperture 32.

Still, it may now be appreciated that one reason to clamp the charge, rather than securing it by upward pressure from the mold, may be to save time by permitting pumpdown and gas filling to start while the mold is installed. This approach may be particularly desirable if assembly of the mold must be completed after the mold is within the forming chamber, or if other necessary steps require extra time in preparing the mold for use.

Once the mold and charge are in position, by either method, the door 29 and vent 76 are closed, and the lower chamber pumped out as mentioned above. To provide a pressure-differential "boost" to filling speed and completeness, the lower chamber may be kept at low pressure as also mentioned.

Operation of the forming chamber at low pressure is not always necessary. In cases where the mold 51 has no fine-detail internal features 54 that will form protruding small details of the finished part, or for some other reason no pressure-differential assist is necessary or desirable, low-pressure operation can be omitted.

In such a case, suitable gas connections (not shown) similar to those above at 71–74 can be provided to the forming chamber 21; or alternatively an interconnecting duct (not shown) can be installed between the two chambers. After a preliminary pumpdown of the forming chamber 21, gas can then be admitted to that chamber in generally the same way as described above for the melting chamber 11.

In either event, whether the lower chamber is evacuated or filled with inert gas, the furnace is now ready for operation.

Figure 4:
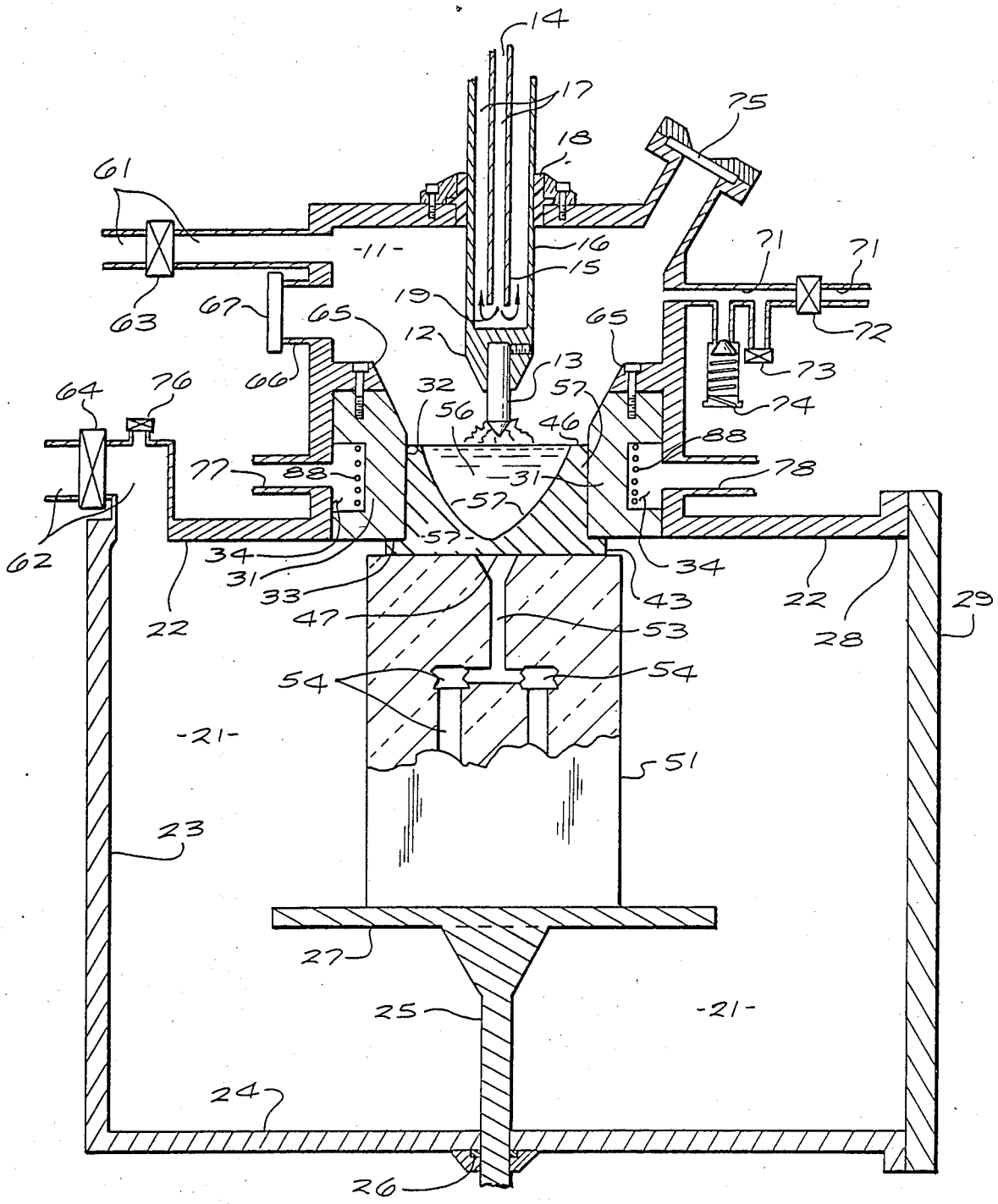
FIG. 4 is a like view showing the same items during operation of the arc heater, just before pouring actually begins—and showing an optional inductive stirring coil installed in the furnace.

As shown in FIG. 4, operation of an arc between the electrode tip 13 and the charge top surface 46 melts that surface to form a pool 56 of molten metal. Ideally, conditions are arranged so that the pool 56 does not extend fully to the aperture wall 32 but rather leaves an unmelted peripheral shell or "skull" 57.

This mode of operation minimizes splash from the pool 56 into the thin annular space between the cylindrical charge pedestal 42 and the cylindrical aperture surface 32. It thereby extends the useful life of the O-ring or other seal.

The condition of the aperture surface 32 is also preserved in this way. Perhaps most importantly, presence of the skull 57 at the periphery of the charge top surface 46 serves as an indicator that the pool has not extended all the way to the bottom outer corners of the charge.

In some situations, however, it will be found more important to let the pool extend radially all the way out to the aperture surface 32. Still, even in those situations, the pool must not be allowed to extend axially to the bottom of the charge where the flange and seal are located.

If that were allowed to occur, the structural integrity of the sealing area would be thereby destroyed and the stable geometry of the system would collapse. Molten titanium could then be sprayed into the forming chamber 21, around the mold 51, rather than flowing into the mold entryway or flash channel 53.

As shown in FIG. 4, an optional inductive coil 88 can be installed in the circumferential water-circulating channel 34 of the wall structure 31. This coil induces electrical eddy currents in the charge. It is not powerful enough to melt the charge 41—but once the molten pool 56 is formed, the electrical eddy currents in turn produce flows or currents in the molten metal itself.

These metal currents tends to stir the pool gently so that it is more uniform in temperature and homogeneous in viscosity. This stirring deters development of stagnant regions where either overheated metal may melt through to the aperture surface 32, or underheated metal may be overly viscous. Such viscous "backwater" portions of the pool may possibly plug the mold after pouring begins.

In addition the inductive stirring tends to enlarge the pool—and probably also tends to change its shape, so that for a given amount of heater power the pool can be slightly deeper and its walls (i.e., the internal contour of the skull) slightly more vertical, as well as more regular.

All of these effects seem to help make the pool relatively more stable and predictable. They appear to aid an operator in determining what power levels—and what appearance of the pool 56 as seen through the viewing port 75—correspond to the situation diagrammed in FIG. 4.

As that illustration shows, the molten pool 56 extends axially downward almost, but not quite, to the bottom surface 47 of the charge. By holding the system in this condition briefly, the operator minimizes the likelihood that viscous "clots" of metal may remain in circulation.

As suggested above, the stirring system seems helpful to reliability and ease of operation. If the operator uses care, however, my furnace can be operated satisfactorily without the stirring coil. Undoubtedly some convective stirring occurs in the pool anyway.

Figure 5:
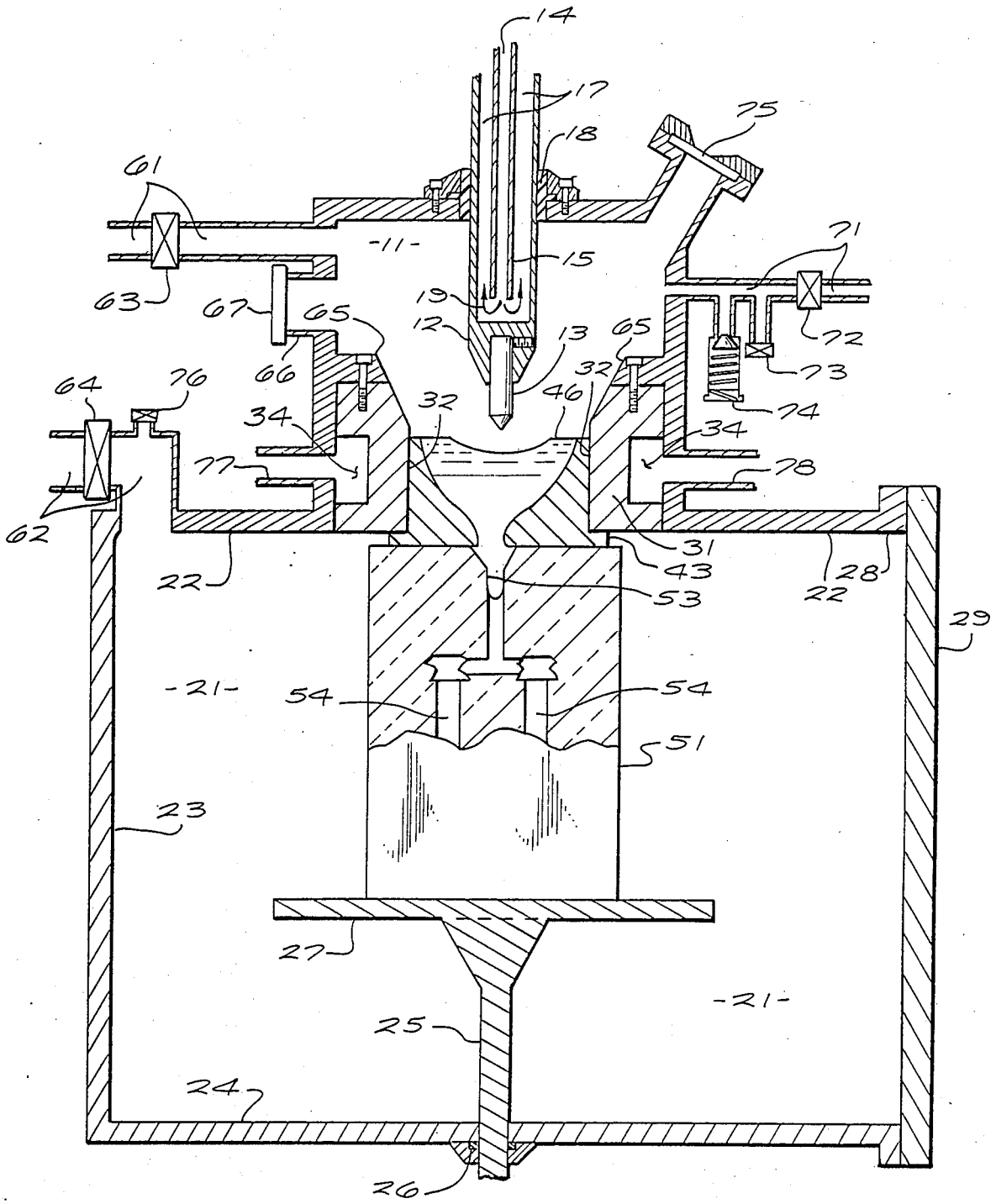
FIG. 5 is a like view showing the same items just as the molten metal begins to flow into the mold.

After the system has been held briefly in the condition sketched in FIG. 4, the operator abruptly "bumps" the power level up so that the thin skull at the bottom of the pool melts smoothly through. Molten metal then flows into the mold flash channel 53, as shown in FIG. 5 under the influence of gravity—and also, if the forming chamber 21 is evacuated and the mold 51 suitably porous or perforated, under the influence of the resulting pressure differential.

Figure 6:
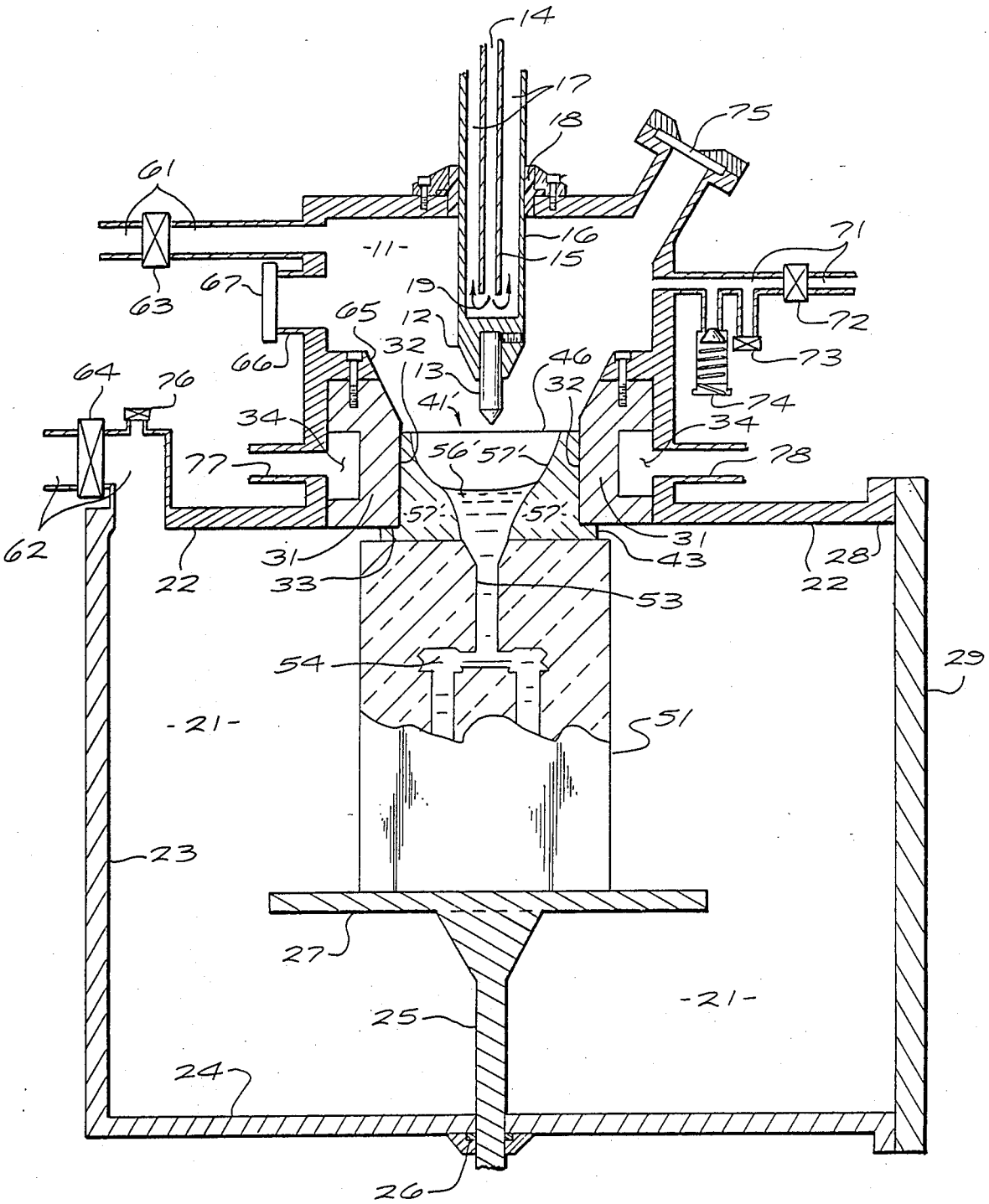
FIG. 6 is a like view with the mold filled, before cooling.

Shortly the mold is filled, as shown in FIG. 6. In that drawing some residual molten metal 56' is shown in the residual charge 41', though the level of this pool is now well below the top of the skull 57'. All the metal in the mold 51—including that in the flash channel 53 and in the detailed internal features 54—is also molten.

Figure 7:
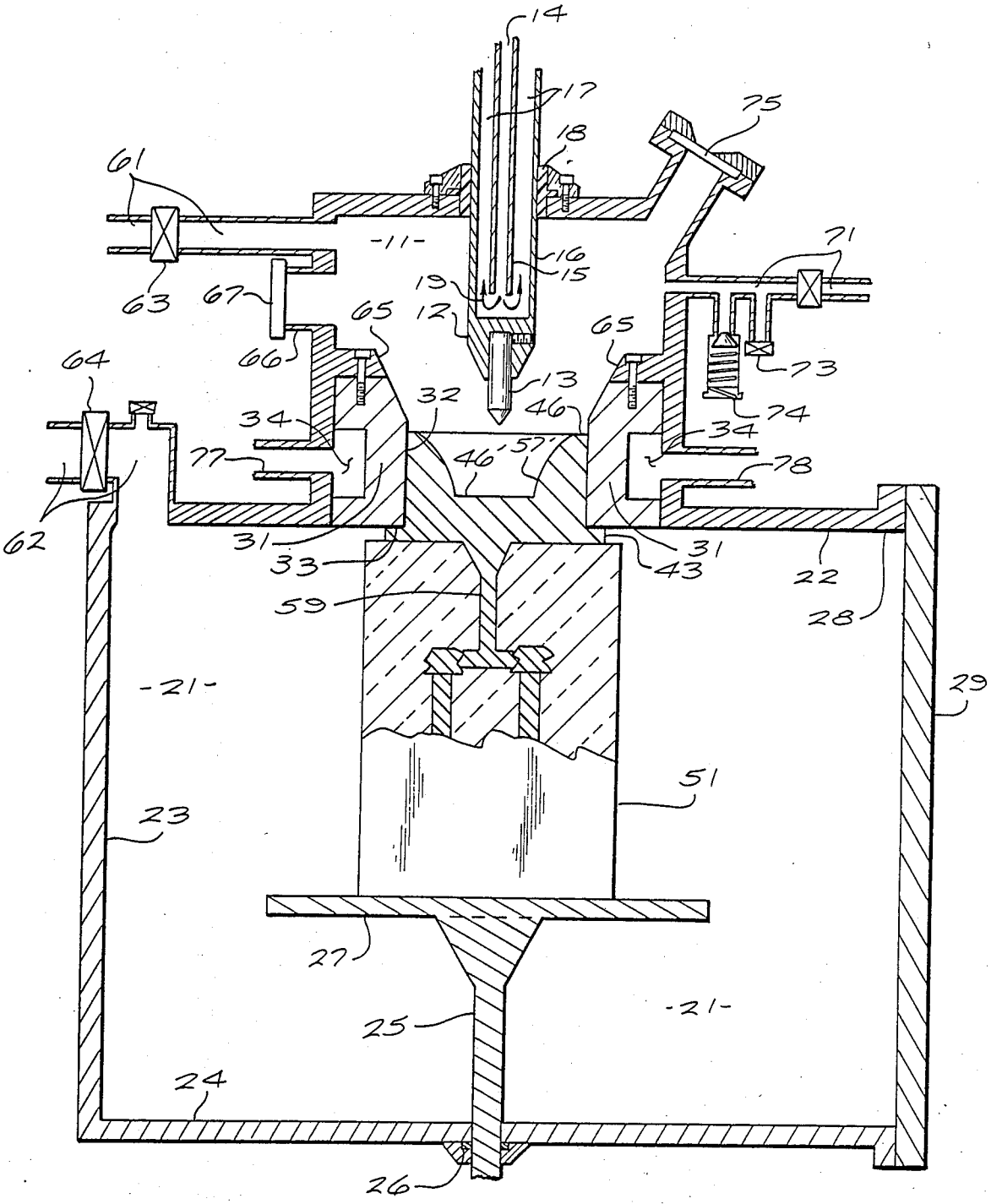
FIG. 7 is a like view after cooling.

Next the arc is shut down and the melt allowed to cool, and eventually the metal is all solid again as shown in FIG. 7. The vent valve 76 and then the door 29 are opened, the elevator 25–27 lowered—and the mold 51, remaining charge 41', and flash 59 then removed, usually all three together.

The furnace is now immediately ready for reuse. A new mold and a new or reconstituted charge are positioned as before, and the cycle repeated. There is no need for the furnace to be out of service for more than a few seconds.

Figure 8:
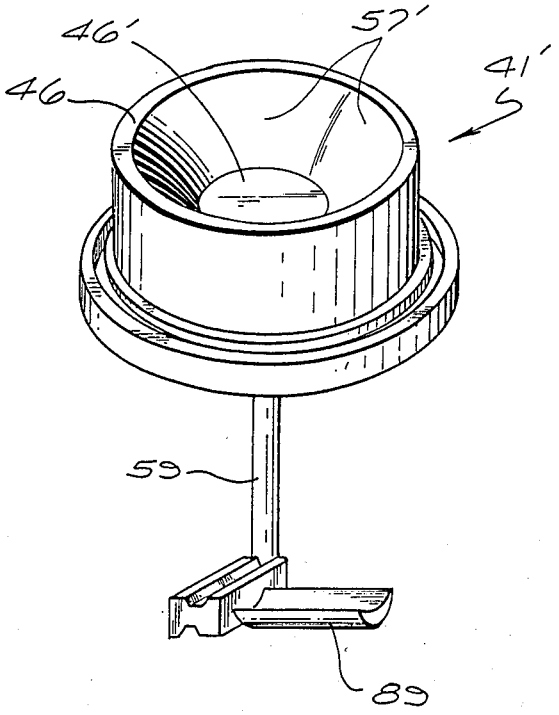
FIG. 8 is a perspective view of the partially used charge, a representative formed metal part, and interconnecting flash all still fused together, after separation (or destruction) of the mold.

During pumpdown or preliminary heating, if desired, the furnace operator if not otherwise engaged can remove (or break away) the mold from the cast part, so that the casting 89, flash 59 and charge 41' appear as in FIG. 8. The operator can also take such opportunities to saw off the flash neatly from the charge (or saw it off roughly and then remachine the charge flat). Alternatively, these external handling steps can be performed in a different order or by other personnel, or at different times, all as convenient.

When a charge 41' such as that shown in FIGS. 7 and 8 is to be reused, the operator can simply place particulate recharge metal (not shown) in the concavity formed by the upper portions of the skull 57' and the solidified top surface 46' of the previously molten pool. This particulate metal will then be raised with the rest of the charge 41' through the aperture 32 and toward or into the melting chamber 11—and will be melted into the pool when the arc starts.

In some cases by operator inadvertence or otherwise the system may deliver a short pour, so that the casting portions of the mold 51 are not completely filled and the metal in the mold probably not continuous with the residual skull. Also possible is a marginally adequate pour, so that the cast part is complete but the flash channel is not full and the finished part perhaps not continuous with the residual skull.

Figure 9:
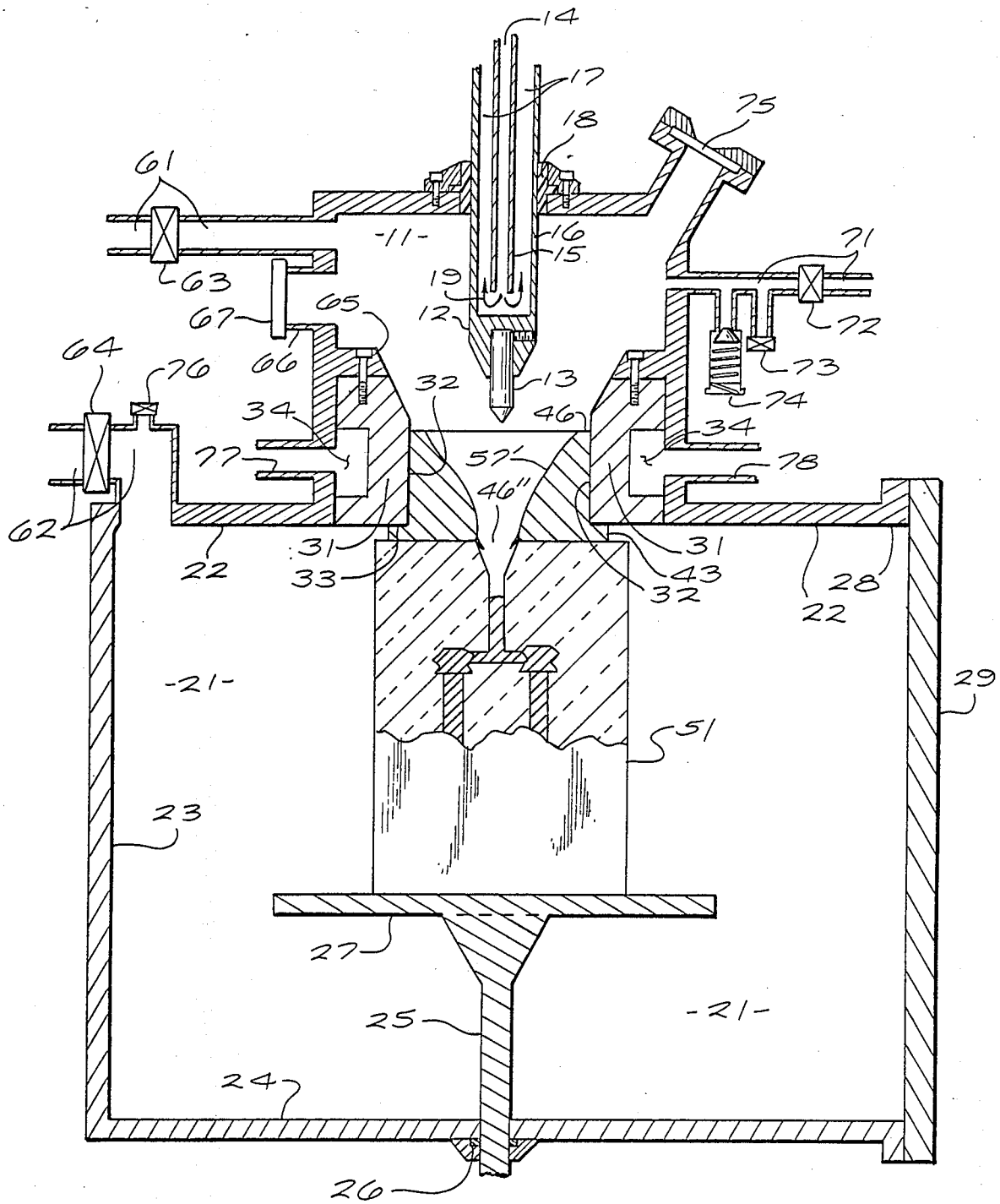
FIG. 9 is a view similar to FIG. 7, but illustrating the condition of the charge and mold in event of a short or marginally adequate pour.

In either of these cases the bottom of the resolidified charge is likely to be perforated as at 46''. FIG. 9 illustrates such a perforated charge. As will be apparent, a charge cannot be reused in this condition.

If particulate recharge metal were placed in the upper concavity of the charge and remelted, it would be likely to flow prematurely through the perforation 46'' into the mold—rather than forming preliminarily into a controllable, homogeneously fluid pool. Plugging of the mold would almost certainly result.

Figure 11:
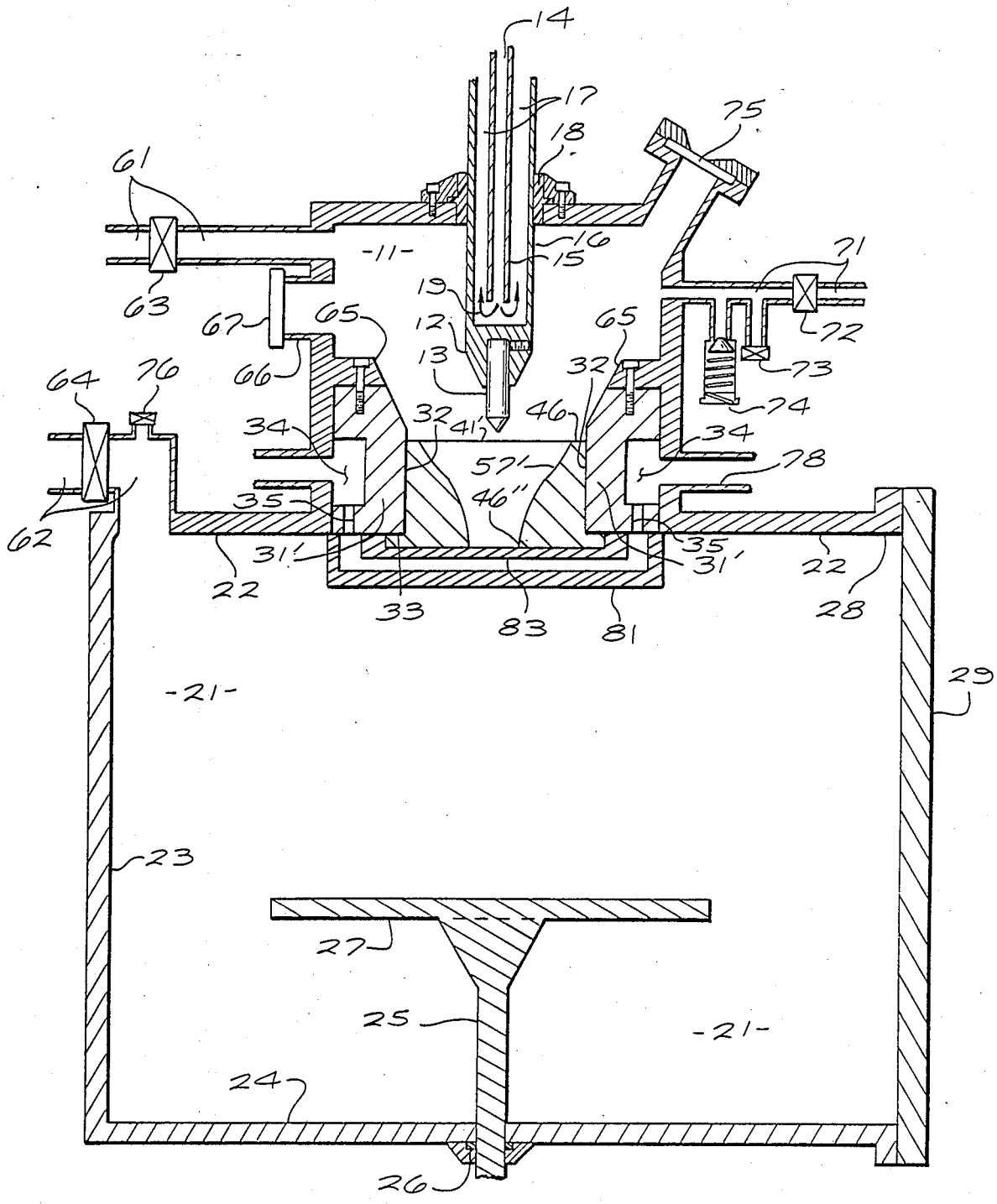
FIG. 11 is a view like FIG. 3, showing the charge replaced in the chamber with the FIG. 10 sealing plate, ready for reconstitution of the charge.

A charge in the condition of FIG. 9, however, is readily reconstituted through use of a sealing plate 81 (FIGS. 10 and 11). The plate 81 has a circular recess 82, equal in depth to the height of the charge flange 43, and internal ducts 83 for circulation of cooling water.

FIG. 11 illustrates use of this plate in the furnace. The internal ducts 83 may be aligned with supply ducts 35 formed in a slightly modified wall member 31' (FIG. 11) to receive some of the cooling water supplied to the aperture channel 34.

Alternatively, if preferred, the cooling ducts 83 in the sealing plate may be connected to a cooling-water supply by suitable connection nipples and tubing (not shown) through the ceiling 22 of the forming chamber 21.

The perforated charge 41' is held in the recess 81 of the sealing plate, and particulate recharge material is placed in the skull. The upper part of the furnace is then operated in the usual fashion, melting the recharge material to reconstitute the charge 41' so that it regains a condition generally as shown in FIG. 2.

Some large industrial firms engaged in reactive-metal fabrication have developed an operating philosophy that precludes contact between the molten metal to be cast (e.g., molten titanium) and anything but water-cooled copper. Two such fabricators, for example, are Pratt-Whitney and General Electric.

Placement of the mouth 52 of a mold 51 against the undersurface 47 of a charge as in FIG. 3 would be unacceptable in such facilities. Some of the molten metal passing from the charge toward the interior of the mold might contact the upper, outer surfaces of the mouth 52, which arguably could be contaminated relative to the interior of the mold 51.

Figure 13:
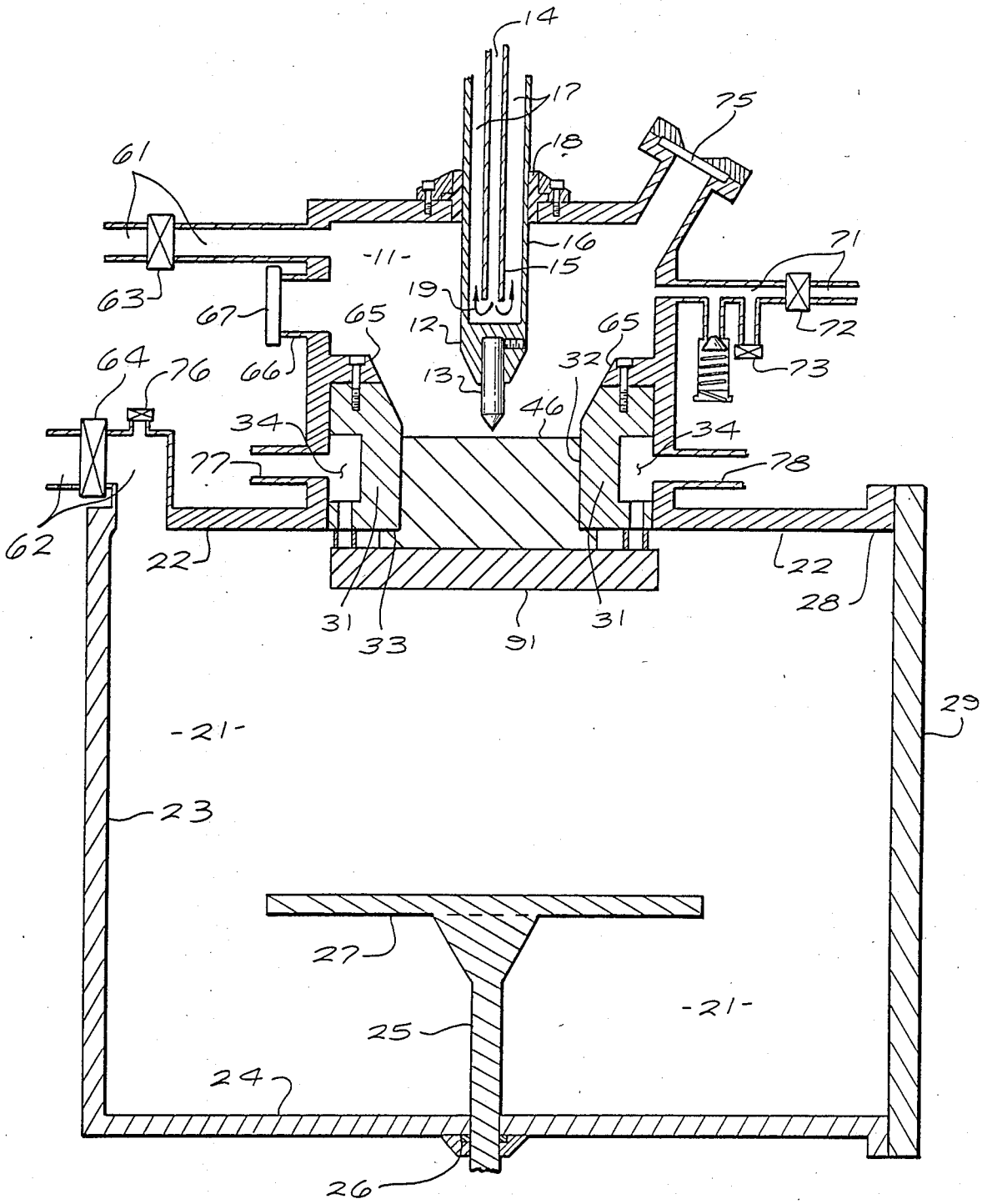
FIG. 13 is a view similar to FIG. 3, but showing the furnace ready for use with the FIG. 12 pouring plate.

My invention is nonetheless usable in such facilities by interposition of a segmented pour plate 91 (FIGS. 12 and 13). This plate is formed in two separate halves 92, 93 that have internal ducts 94 for cooling-water circulation. When the two segments 92, 93 are joined—as by optional bolts 95—the cooling ducts 94 of the two segments make sealed interconnection, so that only one set of external water connections is needed.

Such external water connections may be provided via the aperture 31, as shown in FIG. 13 and generally as described earlier for the sealing plate 81. Alternatively, if preferred, they may be made by suitable connection nipples and hoses (not shown) through the ceiling or wall of the forming chamber.

A central orifice 96 passes the melt through to the mold. The two halves of the segmented plate 91 are advantageously supported by horizontal retractor rods (not shown), which in turn are actuated hydraulically, pneumatically or mechanically to open the plate and permit lowering of the charge together with the mold and product.

Furnaces can be constructed in accordance with my invention to deliver less than one gram to more than a thousand pounds of molten metal to a mold. Below are representative dimensions and other parameters for a medium-size furnace, suited for delivering fifty pounds of metal. For a furnace this size, the chamber walls should be water cooled. Dimensions in this table are in inches.

| | |
|---|---|
| melt chamber 11 | |
| height above bulkhead | 24 to 36 |
| overall diameter | 36 to 48 |
| wall thickness (water cooled) | 0.5 |
| electrode diameter | 6 |
| electrode outer wall | 0.25 |
| electrode inner-tube diameter | 0.75 |
| electrode inner-tube wall | 0.13 |
| electrode tip diameter | 2 to 3 |
| pressure when evacuated | under 1 micron |
| pressure when argon-filled | over 100 psi |
| forming chamber 21 | |
| height | 48 |
| width, depth | 36 |
| wall thickness | 0.5 |
| elevator platform diameter | 36 |
| elevator cylinder diameter | 6 |
| pressure when evacuated | under 1 micron |
| wall structure 31 | |
| overall height | 15 |
| internal diameter | 10 |
| water-channel height | 8 to 10 |
| water-channel depth | 3 to 4 |
| charge 41 | |
| overall height | 8 |
| diameter of central pedestal | 10 |
| height of sealing flange | 1 |
| diameter of sealing flange | 12 to 14 |
| depth of O-ring groove | 0.25 to 0.75 |
| annular width O-ring groove | 0.25 to 0.75 |

I claim:

1. The combination of a furnace, a solid charge of metal, and a form for receiving molten metal; said combination comprising:

a structure defining a melting chamber that has an aperture;

a structure defining a forming chamber that is at least partially below the melting chamber and communicates with the melting chamber through the aperture;

means for receiving a solid charge of metal from below to block the aperture;

a solid charge of metal, received at the receiving means;

means, associated with the melting chamber, for heating the charge to melt part of the metal; and a form, disposed in the forming chamber below the charge, to receive molten metal from the bottom of the charge.

2. The combination of claim 1, wherein:

the form is a mold for casting of a useful article.

3. The combination of claim 1, wherein:

the form is a shaped sealing plate for reconstituting a complete solid charge for use in casting.

4. The combination of claim 1, wherein:

the solid charge has a peripheral portion and a very generally central portion; and the heating means comprise means for melting the very generally central portion of the charge to flow through the bottom of the charge into the form while leaving at least part of the peripheral portion of the charge solid.

5. The combination of claim 4, wherein:

the heating means heat an upper surface of the charge; and melting of a central portion of the charge, to pass the molten metal downward into the mold chamber, provides the exclusive valving function for release of the molten metal in operation of the furnace.

6. The combination of claim 1, wherein:

the metal is reactive and refractory; and the receiving means comprise relatively cool surfaces for drawing heat away from at least some immediately adjacent portions of the charge to maintain those portions as a skull in the solid state.

7. The combination of claim 6, wherein:

the heating means cooperate with the relatively cool surfaces of the receiving means to limit contact of molten portions of the charge to exclusively the skull and the mold.

8. The combination of claim 1, further comprising:

means for hermetically sealing the charge against the receiving means, to isolate the melt chamber from the forming chamber; and means for establishing a pressure differential between the melting chamber and forming chamber to promote complete filling of the form by the melted metal.

9. The combination of claim 1, wherein:

the form is a mold for casting of a useful article; and the forming chamber is sized to receive the a mold for casting of a useful article.

10. The combination of claim 1, wherein:

the form is a shaped sealing plate for reconstituting a complete solid charge for use in casting; and the forming chamber is sized to receive the shaped sealing plate for reconstituting a complete solid charge for use in casting.

11. A furnace for use with a solid charge of metal, and for use with a form for receiving molten metal; said furnace comprising:

a structure defining a melting chamber that has an aperture;

a structure defining a forming chamber that is at least partially below the melting chamber and communicates with the melting chamber through the aperture;

means for receiving such a solid charge of metal from below to block the aperture;

means, associated with the melting chamber, for heating such charge to melt part of such metal; and means for disposing such a form in the forming chamber below such charge, to receive molten metal from the bottom of such charge;

means for hermetically sealing the charge against the receiving means, to isolate the melt chamber from the forming chamber; and means for establishing a pressure differential between the melting chamber and forming chamber to promote complete filling of the form by the melted metal;

wherein the hermetic sealing means seal a bottom surface of the receiving means against such charge.

12. A furnace for use with a solid charge of metal, and for use with a form for receiving molten metal; said furnace comprising:

a structure defining a melting chamber that has an aperture;

a structure defining a forming chamber that is at least partially below the melting chamber and communicates with the melting chamber through the aperture;

means for receiving such a solid charge of metal from below to block the aperture;

means, associated with the melting chamber, for heating such charge to melt part of such metal; and means for disposing such a form in the forming chamber below such charge, to receive molten metal from the bottom of such charge;

wherein the form-disposing means position such form in direct contact with a bottom surface of such charge.

13. A furnace for use with a solid charge of metal, and for use with a form for receiving molten metal; said furnace comprising:

a structure defining a melting chamber that has an aperture;

a structure defining a forming chamber that is at least partially below the melting chamber and communicates with the melting chamber through the aperture;

means for receiving such a solid charge of metal from below to block the aperture;

means, associated with the melting chamber, for heating such charge to melt part of such metal;

means for disposing such a form in the forming chamber below such charge, to receive molten metal from the bottom of such charge; and a segmented metal pouring plate disposed between such charge and such form, to pass such molten metal from the bottom of such charge into such form.

14. The furnace of claim 13, further comprising:

means for water-cooling the pouring plate.

15. The furnace of claim 11, together with:

such a metal charge, received in the receiving means from below, with a top portion of the charge extending into or toward the melting chamber and a bottom portion of the charge extending into or toward the forming chamber; and such a form, disposed in the forming chamber below the pouring plate.

16. In combination, a furnace, a solid charge of metal, and a form for receiving molten metal; said combination comprising:

a structure forming a melting chamber that has an aperture;

a structure defining a forming chamber that is at least partially below the melting chamber and communicates with the melting chamber through the aperture;

a solid charge of metal;

a form;

means for receiving the solid charge of metal and the form together from below to block the aperture;

means, associated with the melting chamber, for heating the charge to melt part of the metal; and means for disposing the form at least partially within the forming chamber, to receive molten metal from the bottom of the charge.

17. In combination, a casting furnace, a solid charge of metal, and a mold; said combination comprising:

a structure defining a mold chamber that has a ceiling;

a solid charge of metal;

means in the ceiling of the chamber for receiving the solid charge of metal from below, said receiving means contacting the solid charge, while the charge is solid, exclusively at a peripheral portion of the solid charge;

a mold;

means for disposing the mold in the mold chamber below the charge;

means for preferentially heating a very generally central portion of the charge, to melt exclusively a very generally central vertical portion of the charge so that at an underside of the charge molten metal flows downward from exclusively the very generally central portion of the underside into the mold while remaining continuous with an unused solid peripheral portion of the charge;

wherein melting of the very generally central portion of the charge, to pass the molten metal downward into the mold chamber, provides the exclusive valving function for release of the molten metal in operation of the furnace; and means for facilitating removal of the molten metal, after cooling, from the furnace by downward motion together with said unused solid peripheral portion of the charge.

18. The combination of claim 17, wherein:

molten metal of the charge touches only the mold and the unmelted peripheral portion of the charge.

19. The combination of claim 17, wherein:

the receiving means comprise a water-cooled metal surface; and after melting of part of the charge, part of the molten metal of the charge contacts the water-cooled metal surface of the receiving means.

20. In combination:

a structure forming a melt chamber that has an aperture;

a structure defining a mold chamber that is at least partially below the melt chamber and communicates with the melt chamber through the aperture; said mold-chamber-defining structure also defining a downward-facing cooled charge-receiving surface that surrounds the aperture;

a solid charge of reactive, refractory metal received from below, at the charge-receiving surface, with a top portion of the charge extending into or toward the melting chamber and a bottom portion of the charge extending into or toward the mold chamber, to block the aperture;

means for hermetically sealing the charge against the receiving surface, to isolate the melt chamber from the mold chamber;

a mold disposed below the charge in the mold chamber;

means, associated with the melt chamber, for heating a generally central upper portion of the charge to melt a generally central vertical part of the metal so that the melted part of the metal flows downward into the mold, while leaving a peripheral portion of the charge as a skull in the solid state;

wherein melting of a central portion of the charge, to pass the molten metal downward into the mold chamber, provides the exclusive valving function for release of the molten metal in operation of the furnace so that in operation of the heating means the molten portions of the charge contact only the skull and the mold; and means for establishing a pressure differential between the melting chamber and molding chamber to promote complete filling of the mold by the melted metal.

21. The combination of claim 20, wherein:
the receiving surface is water-cooled copper and in operation of the furnace draws heat away from immediately adjacent portions of the charge to maintain those portions as said skull in the solid state.

22. The combination of claim 20, wherein:
the mold is disposed in direct contact with a bottom surface of the charge.

23. The combination of claim 20, further comprising:
a segmented metal pouring plate disposed between the charge and the mold, to pass the molten charge metal from the bottom of the charge into the mold.

24. The combination of claim 23, further comprising:
means for water-cooling the pouring plate.

25. A method for casting metal, comprising the steps of:
positioning, from below, a solid charge of such metal against a receiving surface, at an aperture therein that communicates with a melting chamber;
disposing a mold below the charge;
after the positioning and disposing steps, operating a heater in the melting chamber to heat an upper surface of the charge to melt a portion of the charge;
continuing to operate the heater so that the melted portion of the charge extends vertically to the bottom of the charge, and so that molten portions of the charge run from the bottom of the charge into the mold; during which continuing step:
unmelted portions of said solid charge provide the exclusive containing function for restraint of the molten metal, and
said extending of the melted portion of the charge to the bottom of the charge provides the
exclusive valving function for release of the molten metal;
after the continuing step, allowing molten portions of the charge to cool; and
after the allowing step, removing the remaining charge, by downward motion from the receiving surface, and removing the mold and the molded metal from the mold chamber.

26. The process of claim 25, wherein:
the removing step comprises removing the remaining charge, the molded metal in the mold, and the mold all together from the mold chamber.

27. The process of claim 26, further comprising the step of:
after the removing step, separating the remaining charge, the molded metal in the mold, and the mold all from each other.

28. The process of claim 27, further comprising of:
after the removing step, repeating all the aforesaid steps of the process with a plurality of different solid charges; and
wherein each repetition of said aforesaid steps commences before the last-completed performance of said separating step.

29. The process of claim 27, further comprising the step of:
after the removing step, repeating all the aforesaid steps of the process with a plurality of different solid charges; and
wherein each repetition of said aforesaid steps commences without regard for completion of the last preceding separating step.

30. The process of claim 26, further comprising the step of:
before the heater-operating step, filling the melting chamber with a substantially inert gas.

31. The process of claim 30, further comprising the steps of:
before the continuing step, hermetically sealing the charge against a part of the receiving surface that surrounds the aperture, to sealingly block the aperture; and
after the sealing step, reducing pressure in the mold chamber so that the inert gas in the melt chamber tends, during the continuing step, to propel the molten metal downward into the mold.

32. The process of claim 26, further comprising the step of:
after the removing step, repeating all the aforesaid steps of the process with a plurality of different solid charges.

33. The process of claim 32, wherein:
the repeating step comprises, in the positioning steps thereof, reusing at least one of the charges at least once;
whereby some initially unused generally central portion of said at least one charge is used in at least one later repetition of said aforesaid steps.

34. The process of claim 33, further comprising the step of:
adding additional solid metal to the charge before or during the reusing step.

35. A process for casting metal comprising the steps of:
positioning, from below, a solid charge of such metal against a receiving surface, at an aperture therein that communicates with a melting chamber;
disposing a mold below the charge;
after the positioning and disposing steps, operating a heater in the melting chamber to heat an upper surface of the charge to melt a portion of the charge;
continuing to operate the heater so that the melted portion of the charge extends vertically to the bottom of the charge, and so that molten portions of the charge run from the bottom of the charge into the mold; during which continuing step:
unmelted portions of said solid charge provide the exclusive containing function for restraint of the molten metal, and
said extending of the melted portion of the charge to the bottom of the charge provides the exclusive valving function for release of the molten metal;
after the continuing step, allowing molten portions of the charge to cool;
after the allowing step, removing the remaining charge, by downward motion from the receiving surface, and removing the mold and the molded metal from the mold chamber;
after all the aforesaid positioning, disposing, continuing, allowing and removing steps, separating the remaining unmelted charge from the molded metal in the mold, if they are not already separated;
then preparing the remaining unmelted charge for use in repeating the aforesaid steps, by machining away any flash that extends below a prepared bottom surface of the charge, if there is any such flash;

then inspecting the charge to determine whether it has an orifice such as would result from a "short pour"; and if so, then, in a later repetition of the positioning and sealing steps, disposing a sealing plate below the charge to define a new prepared-bottom-surface plane, and providing additional charge metal for melting into the orifice to close the orifice, and then preheating the charge with the additional charge metal to reseal the charge across the orifice, and then allowing the resealed charge to cool, and then removing the sealing plate; and providing enough additional charge metal so that the additional metal when combined with the part of the charge that is available for melting is sufficient to fill the mold at least once, if the portion of the charge that is available for melting is not already sufficient to fill the mold at least once; and then using the charge in a repetition of all said aforesaid positioning, disposing, continuing, allowing and removing steps.

36. The process of claim 25, wherein:

before the heater-operating step, providing enough additional charge metal so that the additional metal when combined with the part of the charge that is available for melting is sufficient to fill the mold at least once, if the portion of the charge that is available for melting is not already sufficient to fill the mold at least once.

37. A metal-casting method comprising the steps of:

positioning a solid charge of such metal in a furnace;

disposing a mold below the charge;

after the positioning and disposing steps, operating a heater in the furnace to melt a portion of the charge, and to extend said melted portion to include a part of the bottom of the charge, so that at least some of the molten portion of the charge runs from the bottom of the charge into the mold; during which operating step:

unmelted portions of said solid charge provide the exclusive containing function for restraint of the molten metal, said extending of the melted portion of the charge to the bottom of the charge provides the exclusive valving function for release of the molten metal, and molten portions of the charge that run into the mold remain continuous with unmelted portions of the charge positioned in the furnace;

after the continuing step, allowing molten portions of the charge to cool; and after the allowing step, removing the remaining charge, the mold and the molded metal in the mold all together from their respective positions during said operating step, said remaining charge and said molded metal being an integral body.

38. The method of claim 37, further comprising the step of:

after the removing step, separating the remaining charge, the molded metal in the mold, and the mold all from each other.

* * * * *